US010662020B2

(12) United States Patent
Takaba

(10) Patent No.: US 10,662,020 B2
(45) Date of Patent: May 26, 2020

(54) SHEET PROCESSING APPARATUS INCLUDING SHIFT UNIT CAPABLE OF SHIFTING SHEET

(71) Applicant: CANON KABUSHIKI KAISHA, Tokyo (JP)

(72) Inventor: Ryo Takaba, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/201,378

(22) Filed: Nov. 27, 2018

(65) Prior Publication Data

US 2019/0161313 A1 May 30, 2019

(30) Foreign Application Priority Data

Nov. 29, 2017 (JP) ..... 2017-229297

(51) Int. Cl.
*B65H 37/04* (2006.01)
*B65H 31/24* (2006.01)
(Continued)

(52) U.S. Cl.
CPC ..... *B65H 37/04* (2013.01); *B65H 29/14* (2013.01); *B65H 31/02* (2013.01); *B65H 31/24* (2013.01); *B65H 31/36* (2013.01); *B65H 33/10* (2013.01); *B65H 2301/4212* (2013.01); *B65H 2301/4213* (2013.01); *B65H 2301/4263* (2013.01); *B65H 2301/42192* (2013.01); *B65H 2301/42194* (2013.01); *B65H 2404/1114* (2013.01); *B65H 2404/1422* (2013.01);
(Continued)

(58) Field of Classification Search
CPC ..... B65H 37/04; B65H 29/14; B65H 31/24; B65H 33/10; B65H 31/02; B65H 31/36
See application file for complete search history.

(56) References Cited

U.S. PATENT DOCUMENTS 5,639,080 A * 6/1997 Evans ..... B42C 1/12 270/58.28
6,241,234 B1 * 6/2001 Saitoh ..... B65H 33/08 270/58.12
(Continued)

FOREIGN PATENT DOCUMENTS

JP 2005132611 A 5/2005
JP 2006151570 A 6/2006
(Continued)

*Primary Examiner* — Patrick H Mackey
(74) *Attorney, Agent, or Firm* — Canon U.S.A., Inc. IP Division

(57) ABSTRACT

A sheet processing apparatus includes an intermediate tray on which a sheet is to be stacked, a stapler to execute stapling processing on the stacked sheet, a discharge tray on which the sheet subjected to the stapling processing by the stapler and discharged from the intermediate tray is to be stacked, a control unit, and a shift unit. The shift unit may shift the sheet to a position on the intermediate tray, wherein the position is outside of a range in which the stapling processing is to be executed. In a state where a first sheet and a second sheet are stacked on the intermediate tray and the second sheet is subject to the stapling processing, the control unit causes the shift unit to shift the first sheet on which the stapling processing is not executed, and causes the stapler to execute the stapling processing on the second sheet.

11 Claims, 9 Drawing Sheets

(51) Int. Cl.

| | |
|---|---|
| ***B65H 29/14*** | (2006.01) |
| ***B65H 31/36*** | (2006.01) |
| ***B65H 31/02*** | (2006.01) |
| ***B65H 33/10*** | (2006.01) |

(52) U.S. Cl.
CPC ..... *B65H 2404/1424* (2013.01); *B65H 2405/11151* (2013.01); *B65H 2701/18269* (2013.01); *B65H 2801/27* (2013.01)

(56) References Cited

U.S. PATENT DOCUMENTS

| | | | | |
|---|---|---|---|---|
| 6,997,451 | B2 * | 2/2006 | Yoshimura | B65H 33/08 270/58.08 |
| 7,213,807 | B2 * | 5/2007 | Blanchard, Jr. | B65H 33/10 270/58.32 |
| 8,100,393 | B2 * | 1/2012 | Ray | B65H 33/06 270/58.31 |
| 8,104,759 | B2 * | 1/2012 | Kawaguchi | B65H 7/00 270/58.08 |
| 8,672,313 | B2 * | 3/2014 | Fukami | B65H 37/04 270/58.09 |
| 8,770,570 | B2 * | 7/2014 | Soga | B65H 31/02 270/58.09 |

FOREIGN PATENT DOCUMENTS

| | | | | |
|---|---|---|---|---|
| JP | 2007320661 | A | | 12/2007 |
| JP | 2012047919 | A | * | 3/2012 |
| JP | 2012047919 | A | | 3/2012 |
| JP | 2015225158 | A | | 12/2015 |

* cited by examiner

NORMAL SHEET
203

NORMAL SHEET
WIDTH DIRECTION
CONVEYANCE DIRECTION

EXCLUDED SHEET

NORMAL SHEET
EXCLUDED SHEET

SHEET PROCESSING APPARATUS INCLUDING SHIFT UNIT CAPABLE OF SHIFTING SHEET

BACKGROUND OF THE INVENTION

Field of the Invention

The present disclosure relates to a sheet processing apparatus and an image forming apparatus which execute stapling processing on sheets.

Description of the Related Art

A sheet processing apparatus that executes stapling processing on sheets has heretofore been known as an example of a sheet processing apparatus which is used by being connected to an image forming apparatus such as a copying machine or a printer.

Japanese Patent Application Laid-Open No. 2006-151570 discusses a sheet processing apparatus that executes stapling processing on sheets after the sheets conveyed to an intermediate tray are aligned in a width direction. A sheet bundle on which the stapling processing is executed is discharged from the intermediate tray to a discharge tray, and then the stapling processing is executed on newly conveyed sheets in the intermediate tray.

In this case, an abnormal state relating to a sheet being conveyed may occur while the sheet is conveyed to the intermediate tray so as to execute stapling processing. Such an abnormal state may occur, for example, when a sheet having a size different from a size which is notified in advance is conveyed. If the abnormal sheet is directly conveyed to the intermediate tray, the stapling processing is executed on the abnormal sheet together with the other sheets stacked on the intermediate tray. Japanese Patent Application Laid-Open No. 2015-225158 discusses a control operation for switching a discharge destination of an abnormal sheet to a tray which is different from the discharge destination of the other sheets. However, there are issues that a structure including a plurality of sheet discharge destinations leads to an increase in the size of the apparatus and the control operation as described above cannot be applied to a structure including only one sheet discharge destination.

Aside from a demand for excluding an abnormal sheet from sheets to be subjected to stapling processing, there is a demand for inserting an index sheet into a sheet bundle on which the stapling processing is executed. If this demand is met, for example, an operation for inserting a questionnaire between materials on which the stapling processing is executed can be automatically performed, which leads to a drastic reduction in operation time. However, there is an issue that a known apparatus which is exclusively used for inserting an index sheet between sheets is expensive and the apparatus increases in size.

SUMMARY OF THE INVENTION

The present disclosure works towards providing a sheet processing apparatus and an image forming apparatus that are capable of executing stapling processing on sheets except a specific sheet, which is not subjected to stapling processing, with a simple structure, while stacking the specific sheet on a tray on which the other sheets are stacked.

According to an aspect of the present disclosure, a sheet processing apparatus includes an intermediate tray on which a sheet is to be stacked, a stapler configured to execute stapling processing on the sheet stacked on the intermediate tray, a discharge tray on which the sheet subjected to the stapling processing by the stapler and discharged from the intermediate tray is to be stacked, a control unit configured to control the stapler, and a shift unit configured to shift the sheet to a position on the intermediate tray, wherein the position is outside of a range in which the stapling processing is to be executed, and wherein, in a state where a first sheet and a second sheet are stacked on the intermediate tray and the second sheet is subject to the stapling processing, the control unit causes the shift unit to shift the first sheet on which the stapling processing is not executed, and causes the stapler to execute the stapling processing on the second sheet.

Further features of the present disclosure will become apparent from the following description of embodiments with reference to the attached drawings.

DESCRIPTION OF THE EMBODIMENTS

Figure 1:
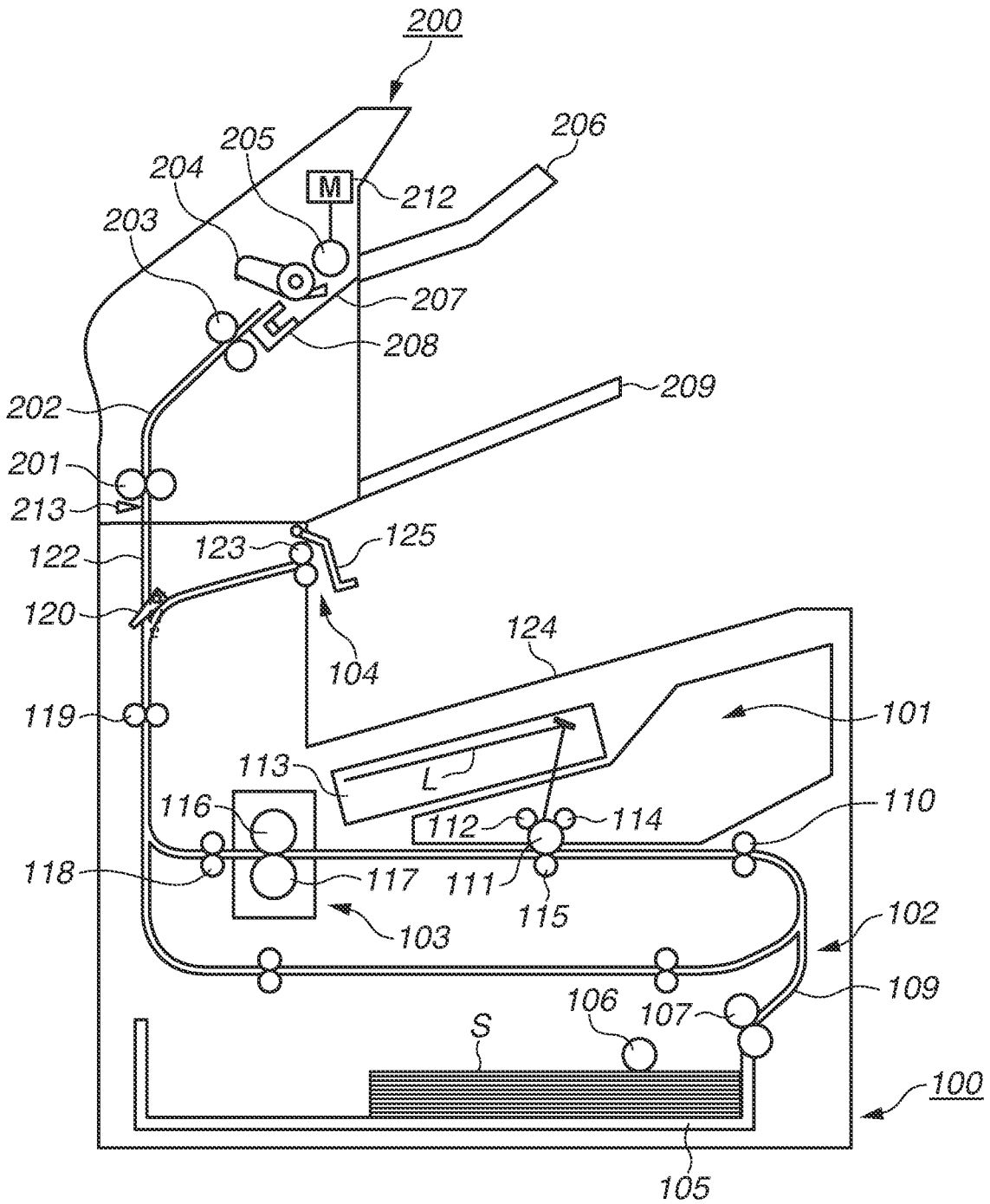
FIG. 1 is a sectional view illustrating a laser beam printer including a post-processing apparatus according to a first embodiment.

FIG. 1 illustrates a schematic structure of an image forming apparatus including a sheet processing apparatus according to a first embodiment of the present disclosure. In the present embodiment, a laser beam printer is illustrated as an example of the image forming apparatus, and a post-processing apparatus that executes stapling processing is illustrated as an example of the sheet processing apparatus. The post-processing apparatus is fixed to the image forming apparatus and integrated with the image forming apparatus.

Referring to FIG. 1, a laser beam printer 100 (hereinafter referred to as the printer 100) is provided with an image forming unit 101, a feed unit 102 that feeds sheets S, such as paper, to the image forming unit 101, a fixing unit 103 that fixes the formed image onto each sheet S, and a discharge unit 104. A post-processing apparatus 200 that performs post-processing, as needed, on the sheet S having an image formed thereon, is attached to an upper portion of the printer 100.

The image forming unit 101 includes a photosensitive drum 111, a charge roller 112, and an exposure apparatus 113. The photosensitive drum 111 rotates clockwise in FIG. 1. The charge roller 112 charges the surface of the photosensitive drum 111. The exposure apparatus 113 irradiates the photosensitive drum 111 with light L to form an electrostatic latent image. The image forming unit 101 also includes a development roller 114 and a transfer roller 115. The development roller 114 puts toner on the electrostatic latent image, which is formed on the surface of the photosensitive drum 111, to form a toner image. The transfer roller 115 transfers the toner image formed on the surface of the photosensitive drum 111 onto the sheet S fed by the feed unit 102. The image forming unit 101 forms the toner image on the sheet S by an image forming process as described above. The fixing unit 103 includes a fixing roller 116, a pressurizing roller 117, and fixing discharge rollers 118. The pressurizing roller 117 is brought into contact with the fixing roller 116 from below. The sheet S is nipped by the fixing roller 116 and the pressurizing roller 117, and the toner image transferred onto the sheet S is fixed onto the sheet S by heat and pressure.

The feed unit 102 includes a cassette 105 on which a plurality of sheets S is stacked, and a pickup roller 106 that picks up the sheets S stacked on the cassette 105. The feed unit 102 also includes feed rollers 107 that feed each sheet S picked up by the pickup roller 106 to a conveyance guide 109. The feed unit 102 also includes registration rollers 110 that convey the sheet S, which has passed through the conveyance guide 109, to a transfer nip portion that is formed by the photosensitive drum 111 and the transfer roller 115.

The discharge unit 104 includes a flapper 120, conveyance rollers 119, discharge rollers 123, a discharge tray 124, and a fully stacked state detection lever 125. The flapper 120 guides the sheet S having an image fixed thereon by the fixing unit 103 to the discharge tray 124 or the post-processing apparatus 200. In the case of guiding the sheet S to the discharge tray 124, the flapper 120 moves to a position indicated by a solid line in FIG. 1. In the case of guiding the sheet S to the post-processing apparatus 200, i.e., a conveyance guide 122, the flapper 120 moves to a position indicated by a broken line in FIG. 1. The flapper 120 is configured to be movable by an actuator (not illustrated). The discharge tray 124 is provided on an upper surface of the printer 100. The sheets S conveyed by the conveyance rollers 119 and the discharge rollers 123 are stacked on the discharge tray 124. If a fully stacked state of the discharged sheets S is detected by the fully stacked state detection lever 125, the printer 100 does not perform image formation until the sheets S stacked on the discharge tray 124 are removed.

Figure 2:
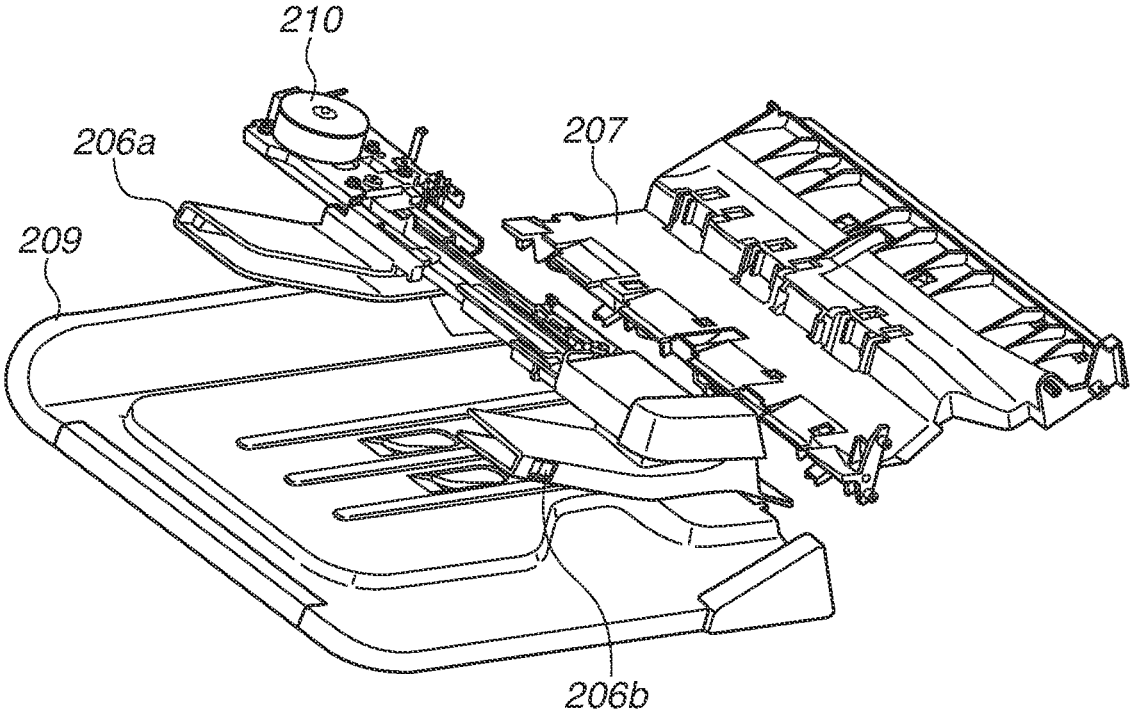
FIG. 2 is a perspective view illustrating the post-processing apparatus according to the first embodiment.

Next, the post-processing apparatus 200 will be described with reference to FIGS. 1 and 2. FIG. 2 is a perspective view illustrating the post-processing apparatus 200.

An inlet roller pair 201 receives each sheet S from the printer 100. A sheet detecting sensor 213 is disposed immediately before the inlet roller pair 201, and detects a leading edge and a trailing edge of the received sheet S. The leading edge refers to a downstream end of the sheet S in a conveyance direction. The trailing edge refers to an upstream end of the sheet S in the conveyance direction. The sheet S conveyed to the post-processing apparatus 200 passes through a conveyance guide 202 and is sent to conveyance rollers 203 (conveyance member). An intermediate tray 207 that temporarily stores the sheet S is disposed downstream of the conveyance rollers 203. On the downstream side of the intermediate tray 207 is provided a jogger 206 that supports both ends of the sheet S in a width direction thereof and aligns the position of the sheet S. The width direction of the sheet S is a direction that is parallel to a stacking surface of the intermediate tray 207 and is orthogonal to the conveyance direction of the sheet S. As illustrated in FIG. 2, the jogger 206 includes a first alignment member **206*a* and a second alignment member 206*b*. The jogger 206 is reciprocally moved in the width direction by an alignment motor 210 to align the position of the sheet S in the width direction. Each sheet S conveyed by the conveyance rollers 203 is stacked in such a manner that the sheet S extends over the jogger 206 and the intermediate tray 207. An alignment paddle 204 (alignment member) and a discharge roller 205 are disposed above the intermediate tray 207. The discharge roller 205 is configured to be rotated by a discharge motor 212 and brought into contact with or separated from the sheet S stacked on the intermediate tray 207. A stapler 208 staples ends of the sheets S which are stacked on the intermediate tray 207 and are aligned by the jogger 206. A discharge tray 209 is disposed vertically below the jogger 206. When the discharge roller 205 is rotated after being brought into contact with the sheets S stacked on the intermediate tray 207 and the jogger 206 moves to a retracted position (which is described in detail below), the sheets S stacked on the intermediate tray 207 are allowed to drop onto the discharge tray 209** and are then discharged.

Figure 3A:
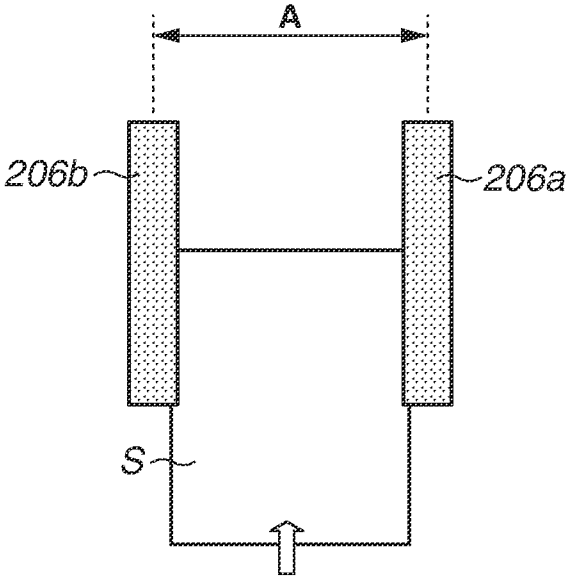
FIGS. 3A, 3B, and 3C are diagrams each illustrating a motion of a jogger during stapling processing.
Figure 3B:
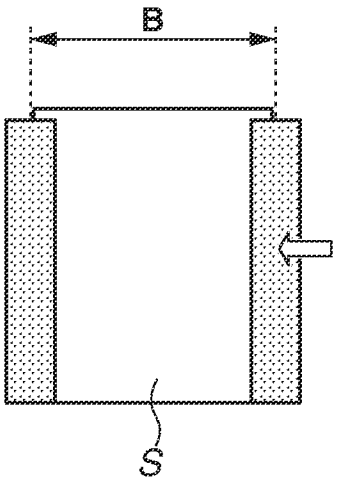
Figure 3C:
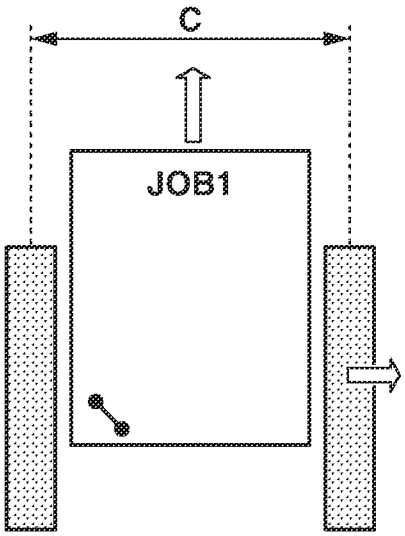

A process flow in which the sheet S is conveyed from the printer 100 to the post-processing apparatus 200 and stapling processing is executed on the sheet S by the stapler 208 will be described in detail. First, the inlet roller pair 201 conveys the sheet S, which has been conveyed from the printer 100, to the conveyance rollers 203 through the conveyance guide 202. The conveyance rollers 203 convey the sheet S to the intermediate tray 207. At this point, the discharge roller 205 is located at a position spaced apart from the sheet S to be stacked on the intermediate tray 207. The jogger 206 moves to a position where the jogger 206 can receive the sheet S before the sheet S is conveyed to the intermediate tray 207 by the conveyance rollers 203. This state is illustrated in FIG. 3A. FIGS. 3A, 3B, and 3C each illustrate the jogger 206 as viewed from vertically above. The position where the jogger 206 can receive the sheet S indicates a state where an interval between the first alignment member **206*a* and the second alignment member 206*b* is represented by "A". The interval A may be an interval which is longer than the length of the sheet S in the width direction and at which the leading edge of the sheet S does not collide with each alignment member when the sheet S is conveyed by the conveyance rollers 203. The first alignment member 206*a* and the second alignment member 206*b* are operated in a linked manner by the alignment motor 210**.

The jogger 206 supports the both ends in the width direction of the sheet S stacked in such a manner that the sheet S extends over the jogger 206 and the intermediate tray 207. Specifically, the first alignment member **206*a* contacts one end of the sheet S in the width direction, and the second alignment member 206*b* contacts the other end of the sheet S in the width direction. Then, the jogger 206 moves along the width direction to align the position of the sheet S in the width direction. This state is illustrated in FIG. 3B. The position where the jogger 206 aligns the position of the sheet S indicates a state where the interval between the first alignment member 206*a* and the second alignment member 206*b*** is represented by "B". The interval B is narrower than the interval A. The interval B is an interval that is equal to the length of the sheet S in the width direction, or an interval obtained by adding some margin to the length of the sheet S.

In the present embodiment, the second alignment member 206*b* is stopped by a mechanical stopper (not illustrated) so as to serve as a reference position for alignment, and only the first alignment member 206*a* moves in the width direction. Specifically, the sheet S is aligned so as to contact the second alignment member 206*b*. However, the present disclosure is not limited to this structure. Only the second alignment member 206*b* may be configured to be movable, or both the first alignment member 206*a* and the second alignment member 206*b* may be configured to be movable.

After completion of the alignment of the sheet S in the width direction by the jogger 206, the position of the sheet S in the conveyance direction is aligned by the alignment paddle 204. The alignment paddle 204 causes the sheet S stacked on the intermediate tray 207 to move to a side where the stapler 208 is disposed, and aligns the sheet S in such a manner that an end of the sheet S contacts the stapler 208. In the manner described above, the alignment processing executed in a case where one sheet S is conveyed to the intermediate tray 207 is completed. In a case where two or more sheets S are subjected to stapling processing in a job, the conveyance rollers 203 convey the next sheet S to the intermediate tray 207. Then, the above-described alignment processing is repeated.

In a case where a plurality of sheets S to be subjected to stapling processing is stacked on the intermediate tray 207 and the alignment processing is performed by the jogger 206 and the alignment paddle 204, the stapler 208 executes stapling processing on the plurality of sheets S. Then, the discharge roller 205 moves to a position in contact with the sheets S stacked on the intermediate tray 207, and discharges the sheets S subjected to stapling processing onto the discharge tray 209. At this point, the jogger 206 moves to the retracted position. This state is illustrated in FIG. 3C. The retracted position of the jogger 206 indicates a state where the interval between the first alignment member 206*a* and the second alignment member 206*b* is represented by "C". The interval C is wider than the interval A. The interval C may be an interval at which each alignment member does not contact the sheets S. The number of sheets S to be subjected to stapling processing may be one.

In a case where a plurality of sheets S is subjected to stapling processing, the alignment processing is executed on each sheet S by the jogger 206 and the alignment paddle 204 in the embodiment described above. However, the alignment processing may be controlled to be executed only when the last sheet S to be subjected to stapling processing is conveyed. The alignment processing to be executed on each sheet S may be different from the alignment processing to be executed when the last sheet S is conveyed. Specifically, in the alignment processing to be executed on each sheet S, each of the interval A and the interval B is set to a wider interval and a rough alignment is performed. When the last sheet S is conveyed, each of the interval A and the interval B is set to be narrower than that when the alignment processing is executed on each sheet S, and a fine alignment is performed so as to align the positions of the plurality of sheets S. Alternatively, the number of times of alignment processing to be executed by the jogger 206 may be changed.

Figure 4:
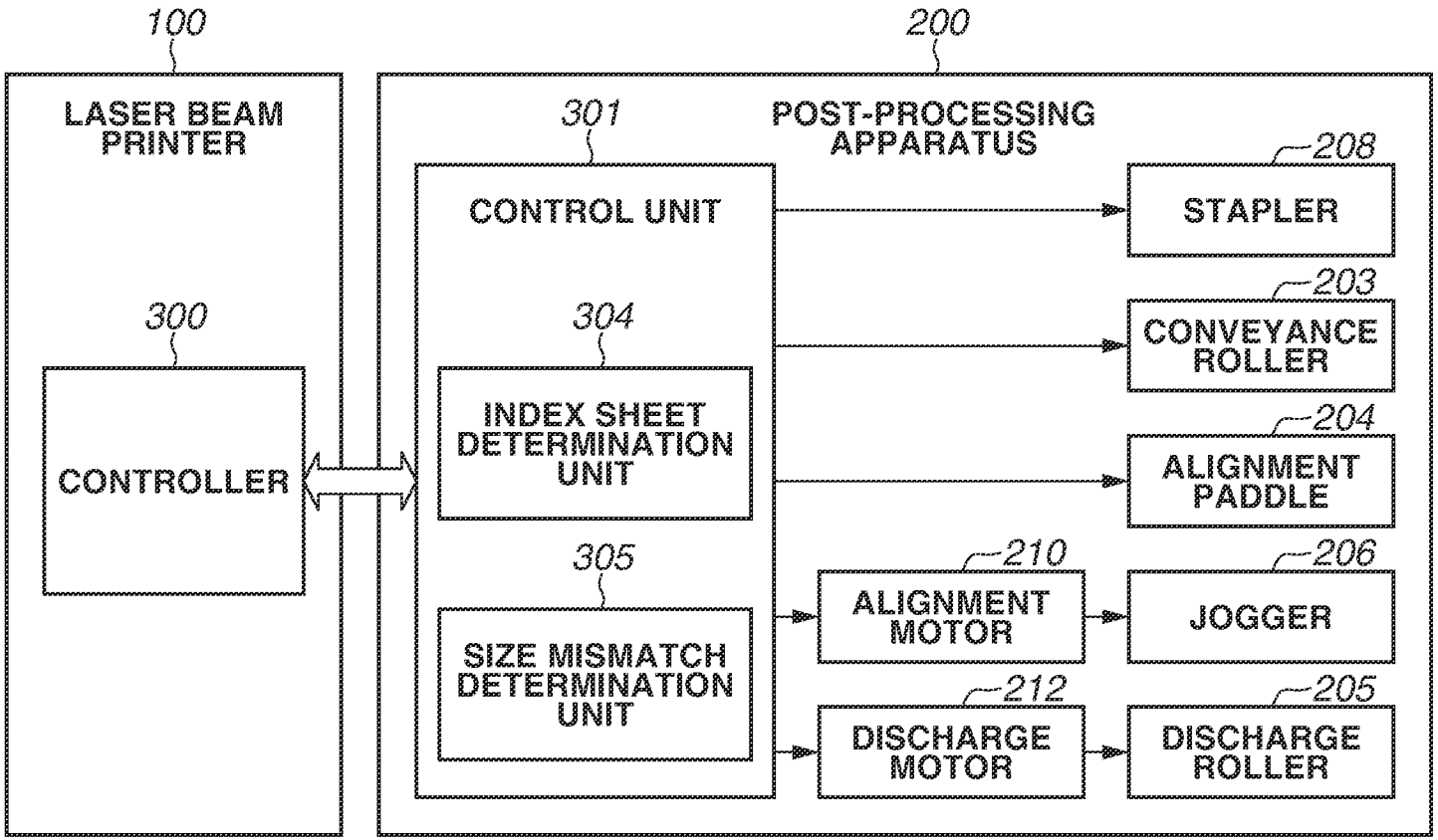
FIG. 4 is a control block diagram of the laser beam printer and the post-processing apparatus according to the first embodiment.

FIG. 4 is a control block diagram of the printer 100 and the post-processing apparatus 200 according to the present embodiment. The post-processing apparatus 200 includes a control unit 301, the stapler 208, the conveyance rollers 203, the alignment paddle 204, the alignment motor 210, the jogger 206, the discharge motor 212, and the discharge roller 205. The control unit 301 includes an index sheet determination unit 304 and a size mismatch determination unit 305. The control unit 301 of the post-processing apparatus 200 is connected to a controller 300 of the printer 100 through a communication line.

The controller 300 communicates with an external apparatus (not illustrated), such as a computer, to receive information about a print job and transmit the received information to the control unit 301. The information about a print job indicates, for example, the size of the sheet S which has an image formed thereon by the printer 100 and is conveyed to the post-processing apparatus 200, a conveyance speed of the sheet S, and whether to execute stapling processing. In the case of executing stapling processing, the information about a print job also includes information indicating whether the conveyed sheet S is the end of one set of sheets S to be subjected to stapling processing. Based on these pieces of information, the control unit 301 controls the stapler 208, the conveyance rollers 203, the alignment paddle 204, the jogger 206, and the discharge roller 205.

The index sheet determination unit 304 determines whether the sheet S being conveyed is an index sheet, i.e., a sheet to be subjected to stapling processing, based on the information sent from the controller 300. The size mismatch determination unit 305 obtains the length in the conveyance direction of the sheet S being conveyed based on the timings when the leading edge and the trailing edge of the sheet S are detected by the sheet detecting sensor 213 and the conveyance speed of the sheet S. Then, the size mismatch determination unit 305 compares the obtained length with the length corresponding to the size of the sheet S indicated in the information sent from the controller 300, and in a case where the difference between the lengths is greater than a predetermined threshold, the size mismatch determination unit 305 determines that an abnormal state due to a size mismatch has occurred. In this case, the size mismatch determination unit 305 treats the sheet S being conveyed as the sheet on which stapling processing is not to be executed, even when the sheet S being conveyed is originally set as the sheet to be subjected to stapling processing.

Figure 5:
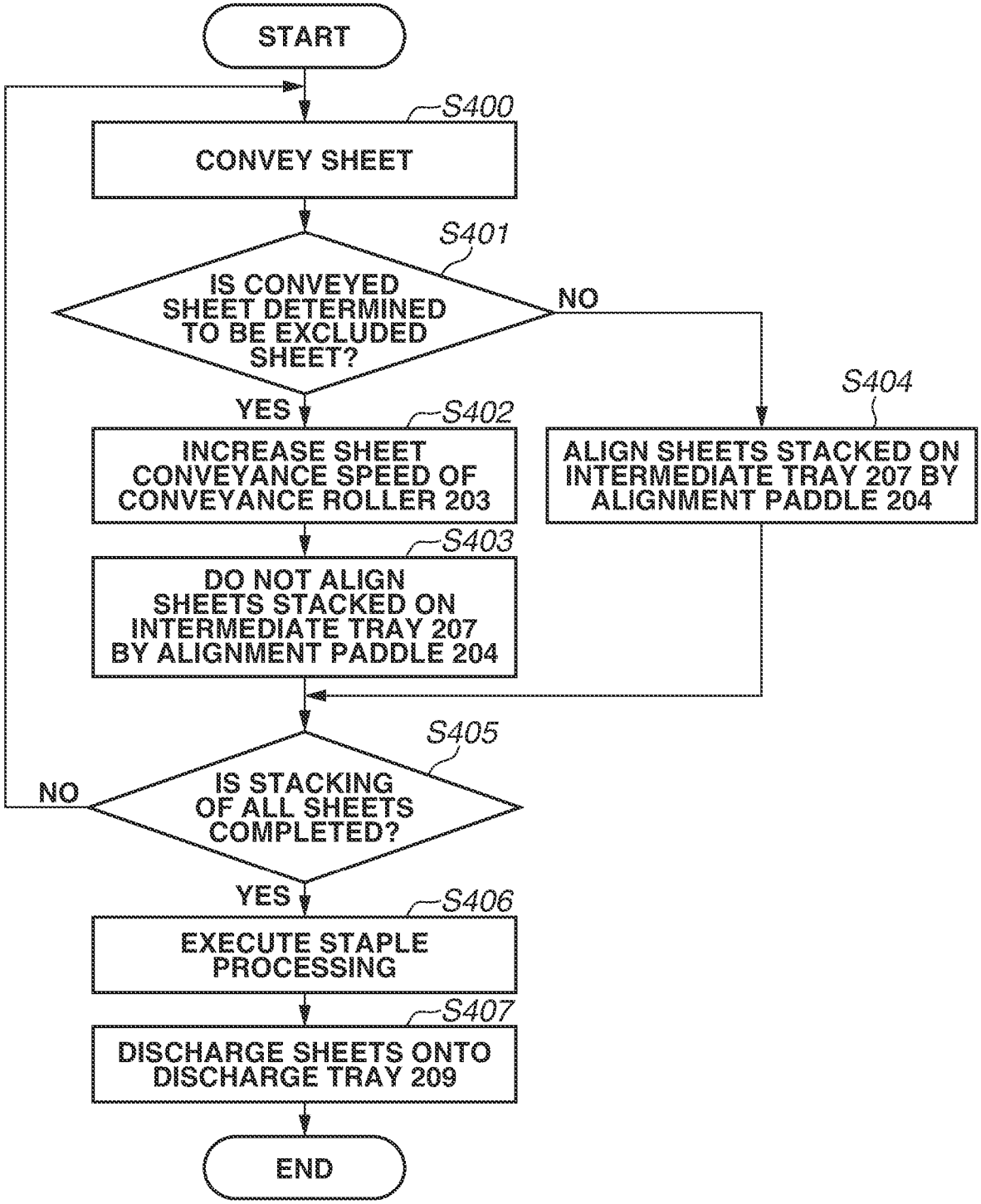
FIG. 5 is a flowchart for executing stapling processing according to the first embodiment.

An operation of the post-processing apparatus 200 in the structure described above will be described with reference to a flowchart illustrated in FIG. 5. A control operation based on the flowchart illustrated in FIG. 5 is executed by the control unit 301 based on a program stored in a storage unit such as a read only memory (ROM) or a random access memory (RAM). Assume herein that a print job involving stapling processing is executed.

First, the control unit 301 receives information about the print job from the controller 300 via a network. The control unit 301 causes the jogger 206 to move to a position where the sheet S is received, before the sheet S is conveyed to the intermediate tray 207. In step S400, the control unit 301 causes the inlet roller pair 201 to convey the sheet S. The control unit 301 sends an inquiry to each of the index sheet determination unit 304 and the size mismatch determination unit 305 about the determination on the sheet S being conveyed. If it is determined that the sheet S being conveyed is an index sheet or a sheet with a mismatched size, in step S401, the control unit 301 determines that the sheet S being conveyed is an excluded sheet (a sheet on which stapling processing is not executed).

Figure 6A:
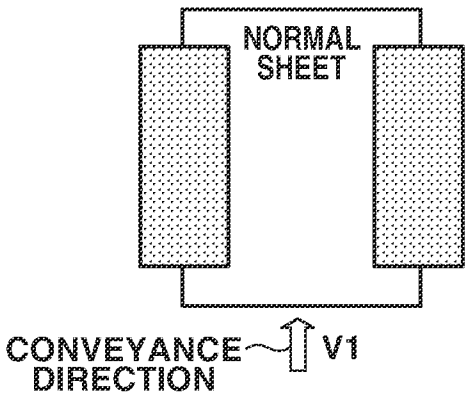
FIGS. 6A, 6B, and 6C are diagrams each illustrating an operation of the post-processing apparatus according to the first embodiment.
Figure 6B:
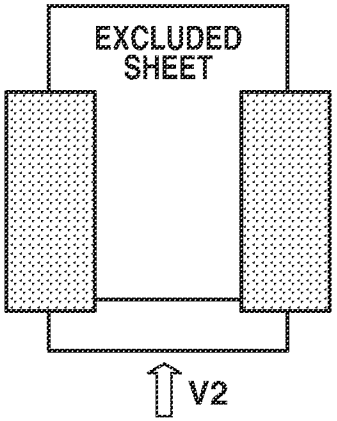
Figure 6C:
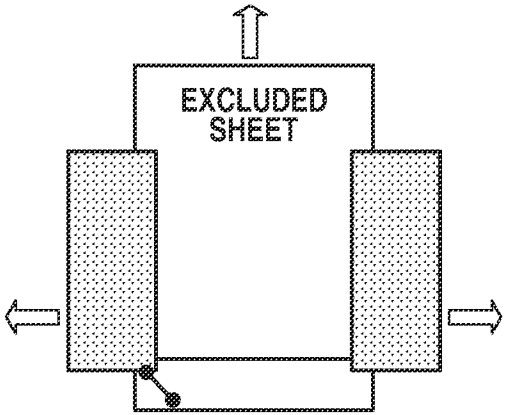

If it is determined that the sheet S being conveyed is not the excluded sheet (NO in step S401), the processing proceeds to step 404 and the control unit 301 causes the conveyance rollers 203 to convey the sheet S to the intermediate tray 207. Assume that the conveyance speed of the sheet S by the conveyance rollers 203 at this point is represented by V1. In step S404, the control unit 301 causes the alignment paddle 204 to align the position of the sheet S stacked on the intermediate tray 207. This state is illustrated in FIG. 6A. FIGS. 6A, 6B, and 6C each illustrate the jogger 206 as viewed from vertically above, like FIGS. 3A, 3B, and 3C. If the sheet S being conveyed is not the excluded sheet, the position in the conveyance direction of the sheet S stacked on the intermediate tray 207 is aligned.

On the other hand, if it is determined that the sheet S being conveyed is the excluded sheet (YES in step S401), as illustrated in FIG. 6B, the control unit 301 executes two processes so that a position where the excluded sheet is stacked on the intermediate tray 207 is set downstream of a normal position in the conveyance direction. In step S402, a first process is executed to set the conveyance speed of the sheet S by the conveyance rollers 203 when the sheet S is conveyed to the intermediate tray 207 to be higher than a normal conveyance speed, thereby increasing the protruding amount of the sheet S. Assuming that the conveyance speed of the sheet S by the conveyance rollers 203 at this point is represented by V2, a relationship of V2>V1 is satisfied. In step S403, a second process is executed not to align the position of the sheet S stacked on the intermediate tray 207 by the alignment paddle 204. More specifically, the position of the excluded sheet is shifted to the downstream side in the conveyance direction by a distance corresponding to a retracted amount in a normal state so that the sheet S stacked on the intermediate tray 207 is prevented from being retracted to the upstream side in the conveyance direction. Processing for shifting the position of the excluded sheet with respect to the position of a normal sheet as described above is referred to as shift processing.

After the sheet S is stacked on the intermediate tray 207, in step S405, the control unit 301 determines whether stacking of a designated number of sheets, which is instructed in a staple instruction from the controller 300, on the intermediate tray 207 is finished. If stacking of all the sheets S is not completed (NO in step S405), the processing returns to step S400 to convey the next sheet S. If stacking of all the sheets S is completed (YES in step S405), the processing proceeds to step S406 and the stapler 208 executes stapling processing. As illustrated in FIG. 6C, the excluded sheet is stacked at a position outside of a range in which stapling processing is executed, and thus stapling processing is not carried out. After stapling processing is executed, in step S407, the control unit 301 opens the jogger 206 and causes the discharge roller 205 to discharge the stapled sheet bundle and excluded sheet onto the discharge tray 209. Thus, the control operation illustrated in this flowchart is terminated.

As described above, according to the present embodiment, it is possible to provide a sheet processing apparatus and an image forming apparatus that are capable of executing stapling processing on sheets except a specific sheet, which is not subjected to stapling processing, with a simple structure, while stacking the specific sheet on a tray on which the other sheets are stacked.

The present embodiment illustrates two processes as processing for shifting the position of the excluded sheet. That is, the first process is executed to increase the conveyance speed of the sheet S, and the second process is executed not to perform alignment processing on the sheet S by the alignment paddle 204. It is not essential to execute both of the two processes. Only one of the two processes may be executed.

In the first embodiment, the position of the excluded sheet is shifted along the conveyance direction of the sheet S, thereby stacking the excluded sheet at a position outside of the range in which stapling processing is executed. The determination as to whether the sheet S being conveyed is the excluded sheet is made based on determination results obtained by the index sheet determination unit 304 and the size mismatch determination unit 305.

In a second embodiment, the position of the excluded sheet is shifted along the width direction (horizontal direction) of the sheet S, thereby stacking the excluded sheet at a position outside of the range in which stapling processing is executed. The conveyance rollers 203 are configured to be movable along the width direction so as to execute shift processing along the width direction. The determination as to whether the sheet S being conveyed is the excluded sheet is made based on a determination result obtained by a remaining sheet presence/absence determination unit 600. Main parts of the second embodiment are similar to those of the first embodiment. Accordingly, only differences between the first embodiment and the second embodiment will be described.

Figure 7:
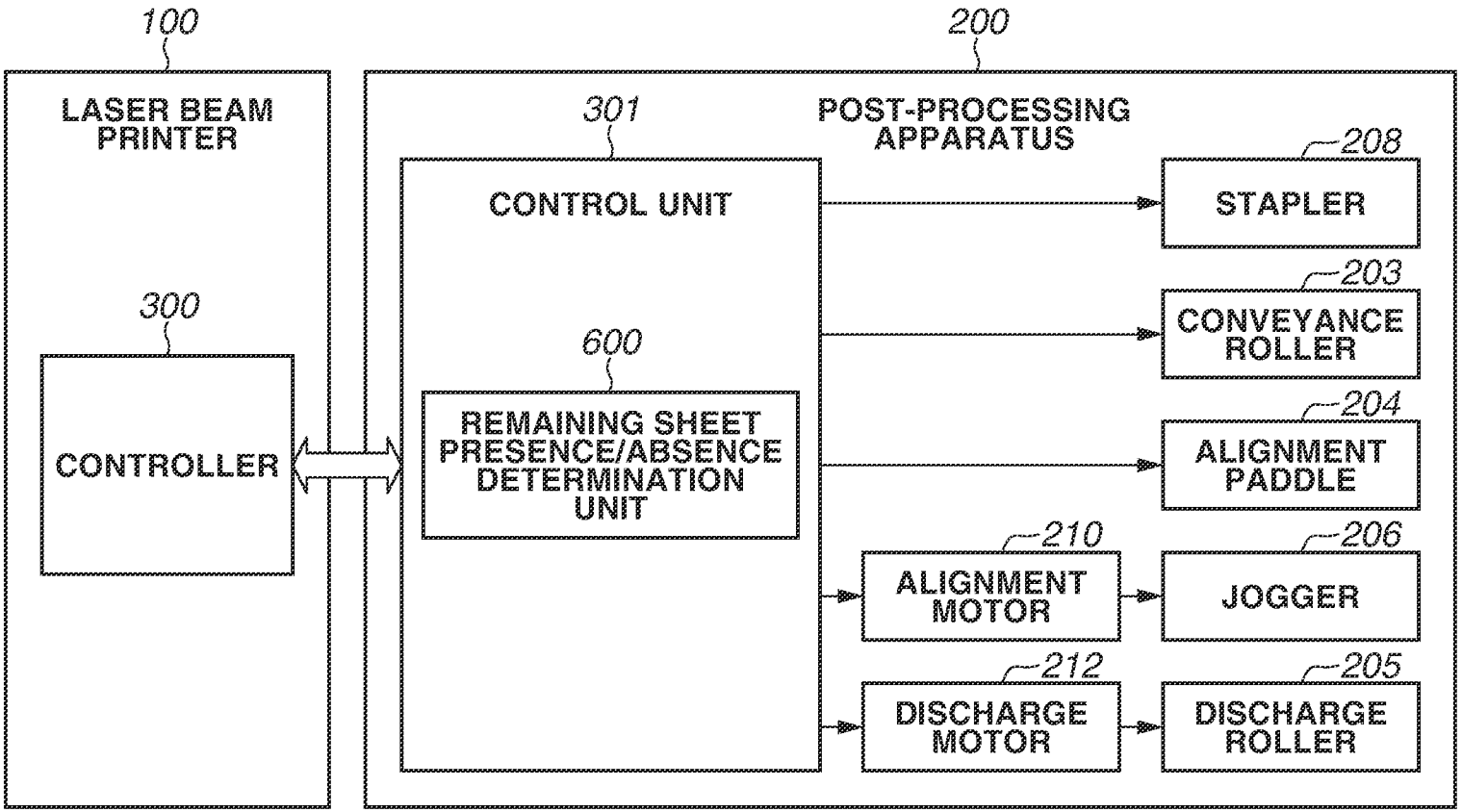
FIG. 7 is a control block diagram of the laser beam printer and the post-processing apparatus according to a second embodiment.

FIG. 7 is a control block diagram of the printer 100 and the post-processing apparatus 200 according to the present embodiment. Unlike the first embodiment, the control unit 301 includes the remaining sheet presence/absence determination unit 600. After the conveyance operation of the sheet S is suspended when an abnormal state due to a jam or the like has occurred and the sheet that has caused the jam is removed for recovery, the remaining sheet presence/absence determination unit 600 determines whether the sheet S is remaining in a main body of each of the printer 100 and the post-processing apparatus 200. In the present embodiment, the remaining sheet presence/absence determination unit 600 determines that the remaining sheet is an excluded sheet on which stapling processing is not performed, and causes the remaining sheet to be automatically conveyed to the intermediate tray 207. Examples of the abnormal state include not only the occurrence of a jam, but also a state where a door provided on the main body of the apparatus is opened by a user.

Figure 8:
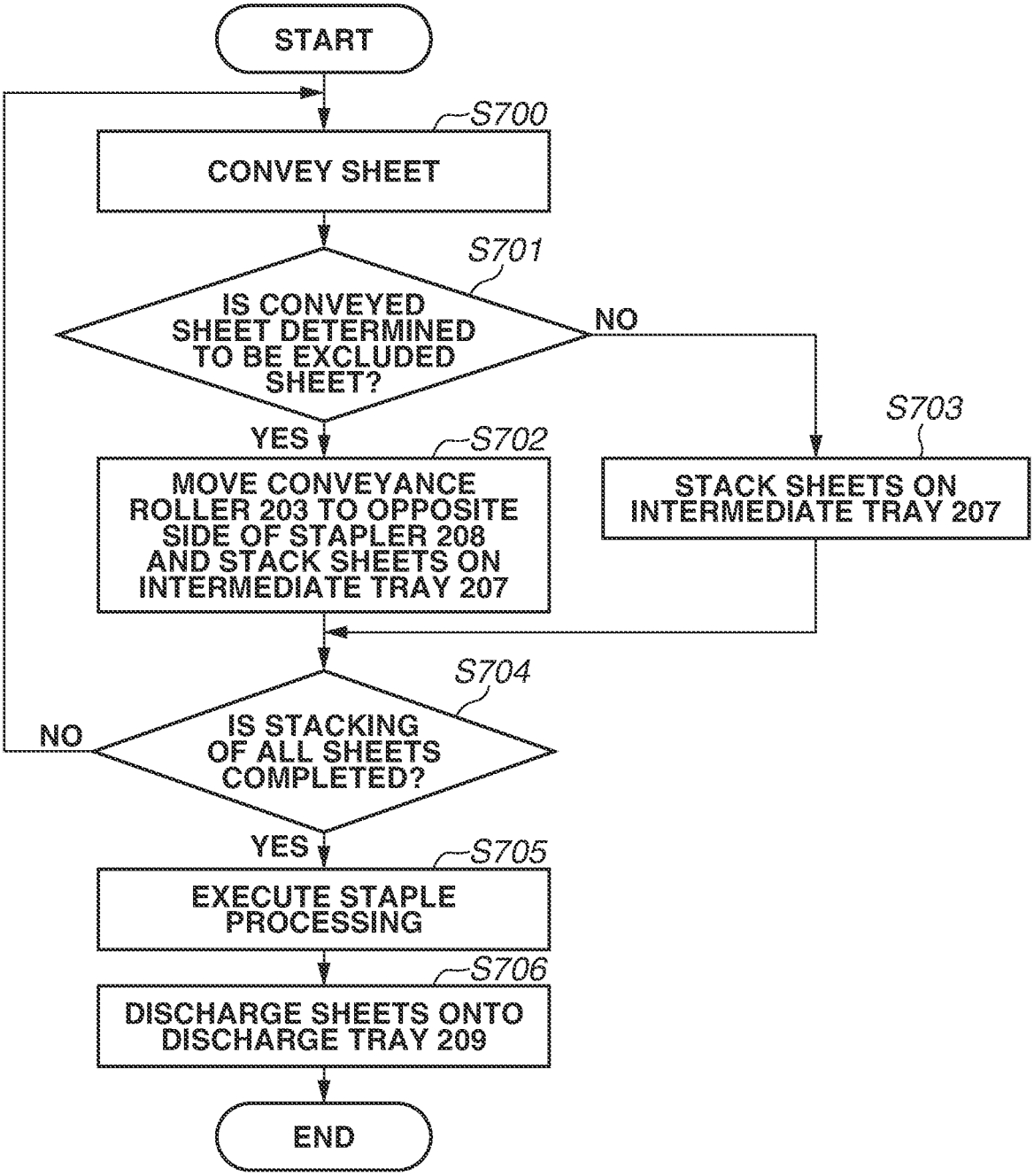
FIG. 8 is a flowchart illustrating processing for executing stapling processing according to the second embodiment.

An operation of the post-processing apparatus 200 according to the present embodiment will be described with reference to a flowchart illustrated in FIG. 8. A control operation based on the flowchart illustrated in FIG. 8 is executed by the control unit 301 based on a program stored in a storage unit such as a ROM or a RAM. Assume herein that a print job involving stapling processing is executed.

Steps S700 and S701 illustrated in FIG. 8 are similar to steps S400 and S401 illustrated in FIG. 5 according to the first embodiment, and thus descriptions of steps S700 and S701 are omitted. The second embodiment differs from the first embodiment in regard to shift processing to be executed when a specific sheet is excluded from the stapling processing target. The shift processing will be described in detail below.

Figures 9A, 9B, 9C, 9D:
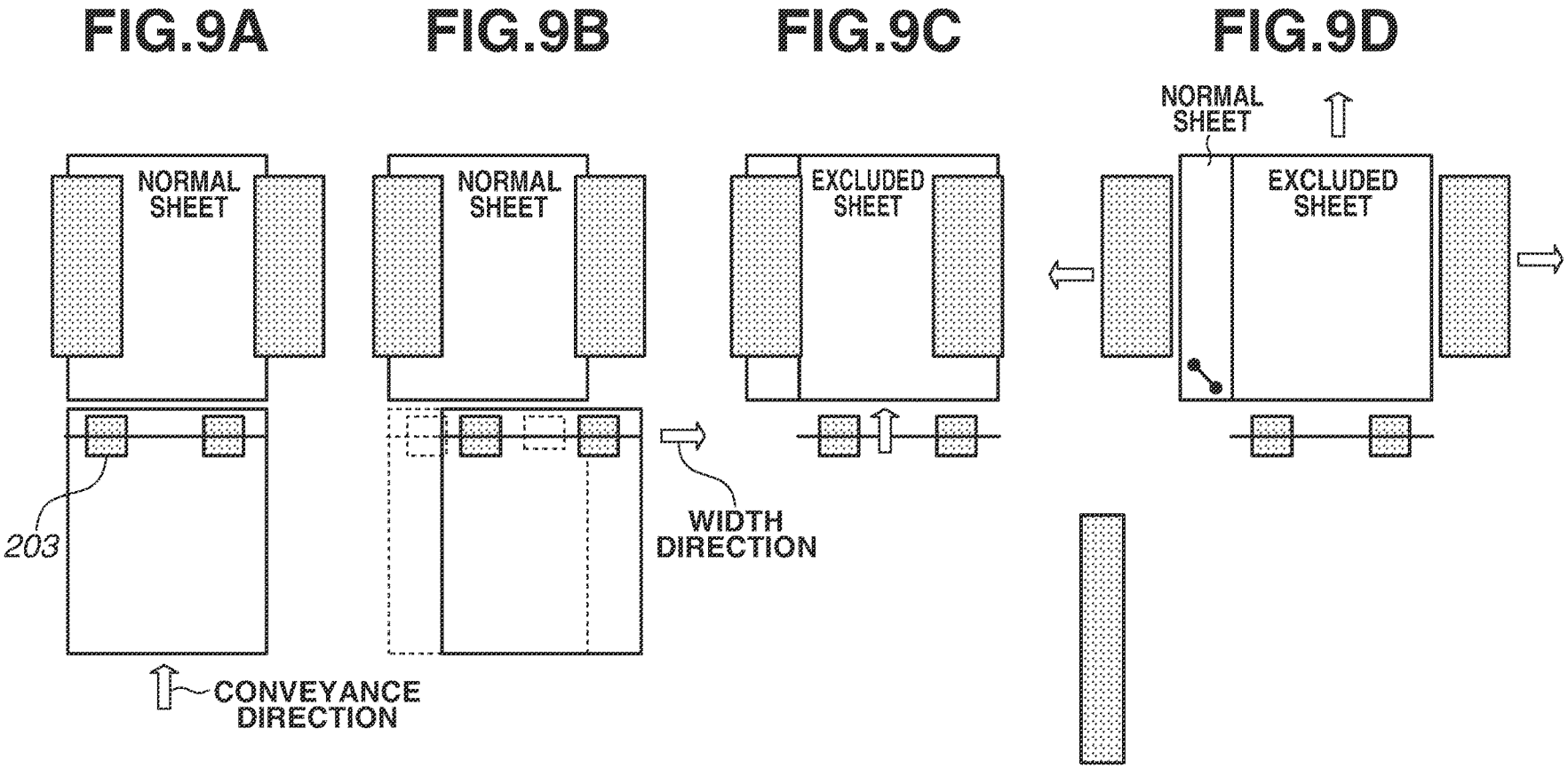
FIGS. 9A, 9B, 9C, and 9D are diagrams each illustrating an operation of the post-processing apparatus according to the second embodiment.

If it is determined that the sheet S being conveyed is not the excluded sheet (NO in step S701), the processing proceeds to step S703 and the control unit 301 causes the sheet S to be conveyed directly to the intermediate tray 207, without moving the conveyance rollers 203 as illustrated in FIG. 9A. FIGS. 9A, 9B, 9C, and 9D each illustrate the jogger 206 as viewed from vertically above, like FIGS. 3A, 3B, and 3C. If the sheet S being conveyed is not the excluded sheet, the position in the width direction of the sheet S stacked on the intermediate tray 207 is aligned.

On the other hand, if it is determined that the sheet S being conveyed is the excluded sheet (YES in step S701), as illustrated in FIG. 9B, the control unit 301 causes the conveyance rollers 203 to move to the side opposite to the position where the stapler 208 is disposed, i.e., to the right side. As a result, the excluded sheet is moved along the width direction together with the conveyance rollers 203. Accordingly, as illustrated in FIG. 9C, in step S702, the excluded sheet is stacked at a position outside of the range in which stapling processing is executed. The conveyance rollers 203 are moved in the width direction at a timing when the sheet S is not nipped by rollers other than the conveyance rollers 203. The subsequent processing (steps S704 to S706) is similar to that of the first embodiment. More specifically, the control unit 301 causes the sheet S to be continuously conveyed until all the sheets S are stacked on the intermediate tray 207, and then executes stapling processing as illustrated in FIG. 8D. After that, the control unit 301 causes the stapled sheet bundle and excluded sheet to be discharged from the intermediate tray 207 onto the discharge tray 209.

As described above, according to the present embodiment, it is possible to provide a sheet processing apparatus and an image forming apparatus that are capable of executing stapling processing on sheets except a specific sheet, which is not subjected to stapling processing, with a simple structure, while stacking the specific sheet on a tray on which the other sheets are stacked.

In the first embodiment described above, the index sheet determination unit 304 and the size mismatch determination unit 305 determine whether the sheet S being conveyed is the excluded sheet. However, like the second embodiment, the remaining sheet presence/absence determination unit 600 may determine whether the sheet S being conveyed is the excluded sheet in the first embodiment. Also, in the second embodiment, the index sheet determination unit 304 and the size mismatch determination unit 305 may determine whether the sheet S being conveyed is the excluded sheet.

The first and second embodiments described above illustrate an example where, as illustrated in FIGS. 6A, 6B, and 6C or FIGS. 9A, 9B, 9C, and 9D, stapling processing is executed in a state where the excluded sheet is placed on a normal sheet. However, the present disclosure is not limited to this example. The stapling processing may be executed in a state where the excluded sheet is sandwiched between a plurality of normal sheets. Also, in this case, shift processing is performed on the excluded sheet, and thus the stapling processing is executed only on the normal sheets.

While the first and second embodiments described above illustrate an example of the post-processing apparatus 200 which is fixed to the printer 100, the present disclosure is not limited to this example. The present disclosure can also be applied to an option apparatus that is detachably mounted on the printer 100.

In the first and second embodiments described above, the control unit 301 provided in the post-processing apparatus 200 executes the above-described control operation. Alternatively, a control unit provided in the printer 100 may be configured to control the post-processing apparatus 200.

While the first and second embodiments described above illustrate a laser beam printer as an example of the image forming apparatus, the image forming apparatus to which the present disclosure is applied is not limited to a laser beam printer. The present disclosure can also be applied to an inkjet printer, printers employing other printing methods, and a copying machine.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-229297, filed Nov. 29, 2017, which is hereby incorporated by reference herein in its entirety.

What is claimed is:

1. A sheet processing apparatus comprising:

an intermediate tray on which a sheet is to be stacked;

a stapler configured to execute stapling processing on the sheet stacked on the intermediate tray;

a discharge tray on which the sheet, subjected to the stapling processing by the stapler and discharged from the intermediate tray, is to be stacked;

a control unit configured to control the stapler; and a shift unit configured to shift the sheet to a position on the intermediate tray along a conveyance direction of the sheet, wherein the position is outside of a range in which the stapling processing is to be executed, and the shift unit includes an alignment member configured to align the position of the sheet stacked on the intermediate tray along the conveyance direction of the sheet, wherein, in a case where a first sheet is subject to the stapling processing and a second sheet is not subject to the stapling processing, the control unit causes the shift unit to shift the second sheet on which the stapling processing is not executed, and causes the stapler to execute the stapling processing on the first sheet in a state where the first sheet and the second sheet are stacked on the intermediate tray, wherein, in a case where the first sheet is conveyed to the intermediate tray, the alignment member aligns a position of the first sheet, and wherein, in a case where the second sheet is conveyed to the intermediate tray, the alignment member shifts a position of the second sheet with respect to the first sheet by not aligning the position of the second sheet.

2. The sheet processing apparatus according to claim 1, wherein, in a case where a third sheet is subject to the stapling processing, the control unit causes the stapler to execute the stapling processing on the first sheet and the third sheet in a state where the second sheet is sandwiched between the first sheet and the third sheet.

3. The sheet processing apparatus according to claim 1, wherein the shift unit includes a conveyance member configured to convey a sheet to the intermediate tray, and wherein the position of the second sheet with respect to the first sheet is shifted by setting a speed at which the conveyance member conveys the second sheet to the intermediate tray to be higher than a speed at which the conveyance member conveys the first sheet to the intermediate tray.

4. The sheet processing apparatus according to claim 1, further comprising a detection unit configured to detect a leading edge and a trailing edge of a sheet to be conveyed, wherein the control unit obtains a length of the sheet in a conveyance direction of the sheet based on a conveyance speed of the sheet and timings when the leading edge and the trailing edge of the sheet are detected by the detection unit, and wherein, in a case where the obtained length is determined to be different from a length corresponding to a predetermined size, the control unit determines that the sheet to be conveyed is the second sheet on which the stapling processing is not executed.

5. The sheet processing apparatus according to claim 1, wherein, in a case where a sheet to be conveyed is an index sheet, the control unit determines that the sheet to be conveyed is the second sheet on which the stapling processing is not executed.

6. The sheet processing apparatus according to claim 1, wherein, in a case where an abnormal state relating to the sheet processing apparatus has occurred, the control unit suspends a sheet conveyance operation, and wherein, in a case where a sheet remaining in a main body of the sheet processing apparatus is present when the sheet processing apparatus is recovered from the abnormal state, the control unit determines that the sheet remaining the main body is the second sheet on which the stapling processing is not executed.

7. A sheet processing apparatus comprising:

an intermediate tray on which a sheet is to be stacked;

a stapler configured to execute stapling processing on the sheet stacked on the intermediate tray;

a discharge tray on which the sheet, subjected to the stapling processing by the stapler and discharged from the intermediate tray, is to be stacked;

a control unit configured to control the stapler; and a shift unit configured to shift the sheet to a position on the intermediate tray along a direction parallel to a stacking surface of the intermediate tray and orthogonal to a conveyance direction of the sheet, wherein the position is outside of a range in which the stapling processing is to be executed, and the shift unit includes a conveyance member configured to be movable along a direction orthogonal to the conveyance direction of the sheet and to convey the sheet to the intermediate tray, wherein, in a case where a first sheet is subject to the stapling processing and a second sheet is not subject to the stapling processing, the control unit causes the shift unit to shift the second sheet on which the stapling processing is not executed, and causes the stapler to execute the stapling processing on the first sheet in a state where the first sheet and the second sheet are stacked on the intermediate tray, and wherein, when the conveyance member conveys the second sheet to the intermediate tray with respect to a position on the intermediate tray to which the conveyance member conveys the first sheet, the conveyance member moves along the orthogonal direction and then conveys the second sheet to the intermediate tray to shift a position of the second sheet with respect to the first sheet.

8. The sheet processing apparatus according to claim 7, further comprising an alignment unit configured to align a position of the sheet stacked on the intermediate tray along the direction parallel to the stacking surface of the intermediate tray and orthogonal to the conveyance direction of the sheet, wherein the alignment unit includes a first alignment member configured to be brought into contact with one end of the sheet in the orthogonal direction, and a second alignment member configured to be brought into contact with another end of the sheet in the orthogonal direction, and wherein a position of the sheet stacked on the intermediate tray is aligned by moving at least one of the first alignment member and the second alignment member in the orthogonal direction.

9. The sheet processing apparatus according to claim 8, wherein, in a case where a sheet is to be conveyed to the intermediate tray, at least one of the first alignment member and the second alignment member is moved to set a first interval between the first alignment member and the second alignment member in the orthogonal direction, wherein, in a case where a position of the sheet stacked on the intermediate tray is to be aligned, at least one of the first alignment member and the second alignment member is moved to set a second interval between the first alignment member and the second alignment member in the orthogonal direction, wherein the second interval is narrower than the first interval, and wherein, in a case where the sheet stacked on the intermediate tray is to be discharged to the discharge tray, at least one of the first alignment member and the second alignment member is moved to set a third interval between the first alignment member and the second alignment member in the orthogonal direction, wherein the third interval is wider than the first interval.

10. The sheet processing apparatus according to claim 9, wherein the sheet conveyed to the intermediate tray is stacked on the intermediate tray in a state where the sheet extends over the intermediate tray, the first alignment member, and the second alignment member, and wherein the sheet stacked on the intermediate tray is allowed to drop onto the discharge tray by moving at least one of the first alignment member and the second alignment member to set the third interval between the first alignment member and the second alignment member in the orthogonal direction.

11. An image forming apparatus comprising:

an image forming unit configured to form an image on a sheet;

an intermediate tray on which a sheet having the image formed thereon by the image forming unit is to be stacked;

a stapler configured to execute stapling processing on the sheet stacked on the intermediate tray;

a discharge tray on which the sheet, subjected to the stapling processing by the stapler and discharged from the intermediate tray, is to be stacked;

a control unit configured to control the stapler; and a shift unit configured to shift the sheet to a position on the intermediate tray along a conveyance direction of the sheet, wherein the position is outside of a range in which the stapling processing is to be executed, and the shift unit includes an alignment member configured to align the position of the sheet stacked on the intermediate tray along the conveyance direction of the sheet, wherein, in a case where a first sheet is subject to the stapling processing and a second sheet is not subject to the stapling processing, the control unit causes the shift unit to shift the second sheet on which the stapling processing is not executed, and causes the stapler to execute the stapling processing on the first sheet in a state where the first sheet and the second sheet are stacked on the intermediate tray, wherein, in a case where the first sheet is conveyed to the intermediate tray, the alignment member aligns a position of the first sheet, and wherein, in a case where the second sheet is conveyed to the intermediate tray, the alignment member shifts a position of the second sheet with respect to the first sheet by not aligning the position of the second sheet.

* * * * *